US008693921B2

(12) United States Patent
Tanaka et al.

(10) Patent No.: US 8,693,921 B2
(45) Date of Patent: Apr. 8, 2014

(54) CHARGING DEVICE AND IMAGE FORMING APPARATUS

(75) Inventors: Arichika Tanaka, Kanagawa (JP); Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 240 days.

(21) Appl. No.: 13/206,119

(22) Filed: Aug. 9, 2011

(65) Prior Publication Data

US 2012/0224888 A1 Sep. 6, 2012

(30) Foreign Application Priority Data

Mar. 4, 2011 (JP) ..... 2011-048151

(51) Int. Cl.
*G03G 15/02* (2006.01)

(52) U.S. Cl.
USPC ..... 399/171

(58) Field of Classification Search
USPC ..... 399/171
See application file for complete search history.

(56) References Cited

U.S. PATENT DOCUMENTS 4,358,681 A * 11/1982 Ando ..... 250/324
2008/0253806 A1 10/2008 Yoshino et al.

FOREIGN PATENT DOCUMENTS

JP 2008-262114 A 10/2008

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

A charging device includes a charging member that charges an outer peripheral surface of a cylindrical image carrier; an electrode member that has the shape of a plate having a longitudinal direction in an axial direction of the image carrier and that is disposed above the charging member; an attachment member that has a curved surface which is curved along the outer peripheral surface of the image carrier, the electrode member being attached thereon; and a pushing member disposed between the electrode member and the image carrier, the pushing member pushing the electrode member toward the curved surface so that the electrode member is curved to follow the curved surface.

9 Claims, 7 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-048151 filed Mar. 4, 2011.

BACKGROUND

The present invention relates to a charging device and an image forming apparatus.

SUMMARY

According to an aspect of the invention, there is provided a charging device including a charging member that charges an outer peripheral surface of a cylindrical image carrier; an electrode member that has the shape of a plate having a longitudinal direction in an axial direction of the image carrier and that is disposed above the charging member; an attachment member that has a curved surface which is curved along the outer peripheral surface of the image carrier, the electrode member being attached thereon; and a pushing member disposed between the electrode member and the image carrier, the pushing member pushing the electrode member toward the curved surface so that the electrode member is curved to follow the curved surface.

BRIEF DESCRIPTION OF THE DRAWINGS

An exemplary embodiment of the present invention will be described in detail based on the following figures, wherein.

DETAILED DESCRIPTION

A charging device and an image forming apparatus according to an exemplary embodiment of the present invention will now be described.

Figure 1:
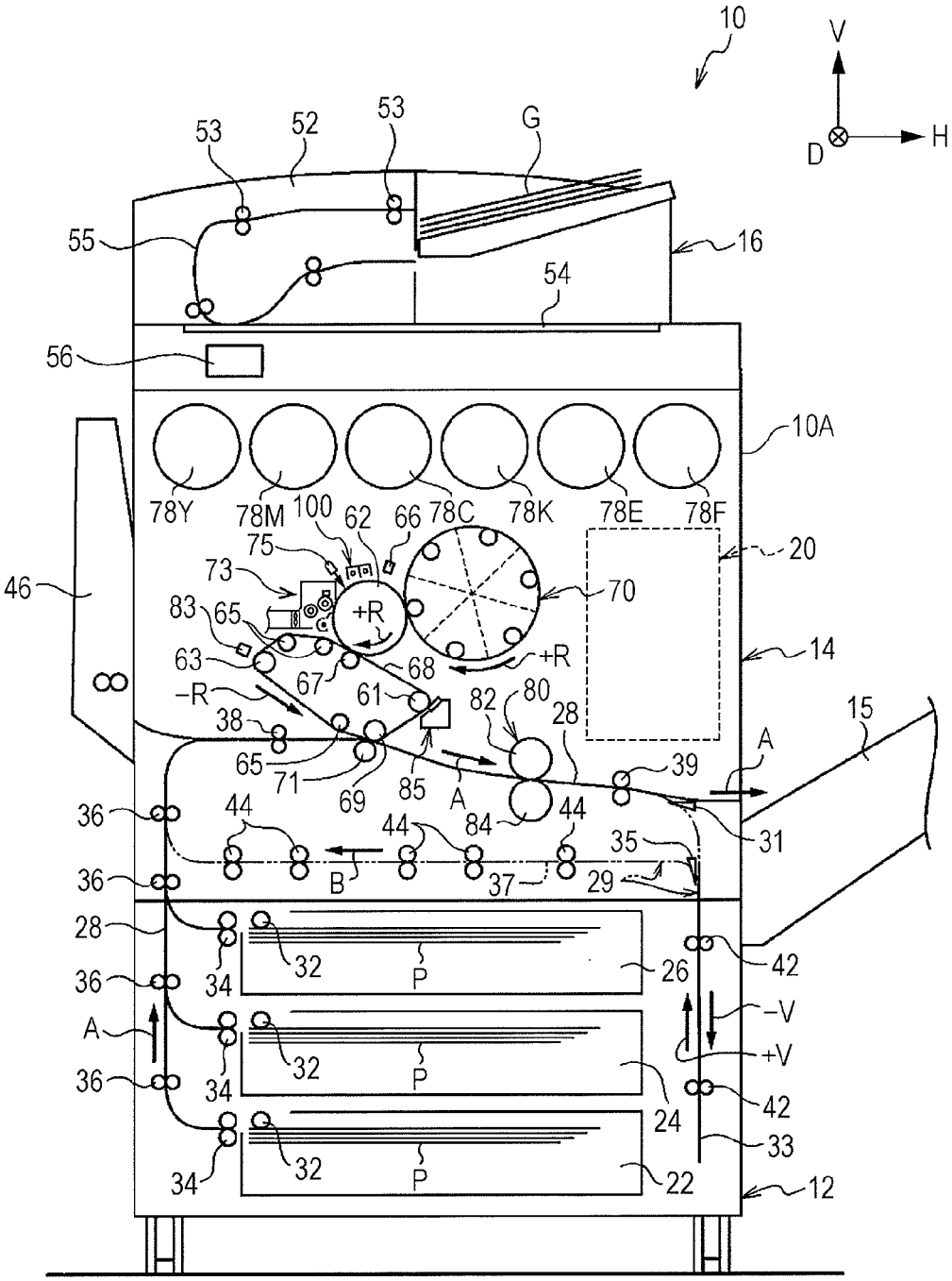
FIG. 1 illustrates the overall structure of an image forming apparatus according to an exemplary embodiment of the present invention.

FIG. 1 illustrates an image forming apparatus 10 according to the exemplary embodiment. The image forming apparatus 10 includes, in order from bottom to top in the vertical direction (direction of arrow V), a sheet storing unit 12 in which sheets of recording paper P, which are examples of recording media, are stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction, the left-right (horizontal) direction, and the depth (horizontal) direction with respect to an apparatus body 10A of the image forming apparatus 10 will be referred to as the direction of arrow V, the direction of arrow H, and the direction of arrow D, respectively.

The sheet storing unit 12 includes a first storage unit 22, a second storage unit 24, and a third storage unit 26 in which the sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 linearly extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow −V (downward in FIG. 1) from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H (leftward in FIG. 1). The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The manual sheet-feeding unit 46 is connected to the transport path 28 at a position in front of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transport rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a photoconductor 62, which is an example of a latent-image carrier, disposed in a central area of the apparatus body 10A. The photoconductor 62 is rotated in the direction shown by arrow +R (clockwise in FIG. 1) by a driving unit (not shown), and carries an electrostatic latent image formed by exposing light thereto. In addition, a scorotron charging unit 100, which is an example of a charging device that charges the surface of the photoconductor 62, is provided above the photoconductor 62 so as to face the outer peripheral surface of the photoconductor 62. The charging unit 100 will be described in detail below.

Figure 2:
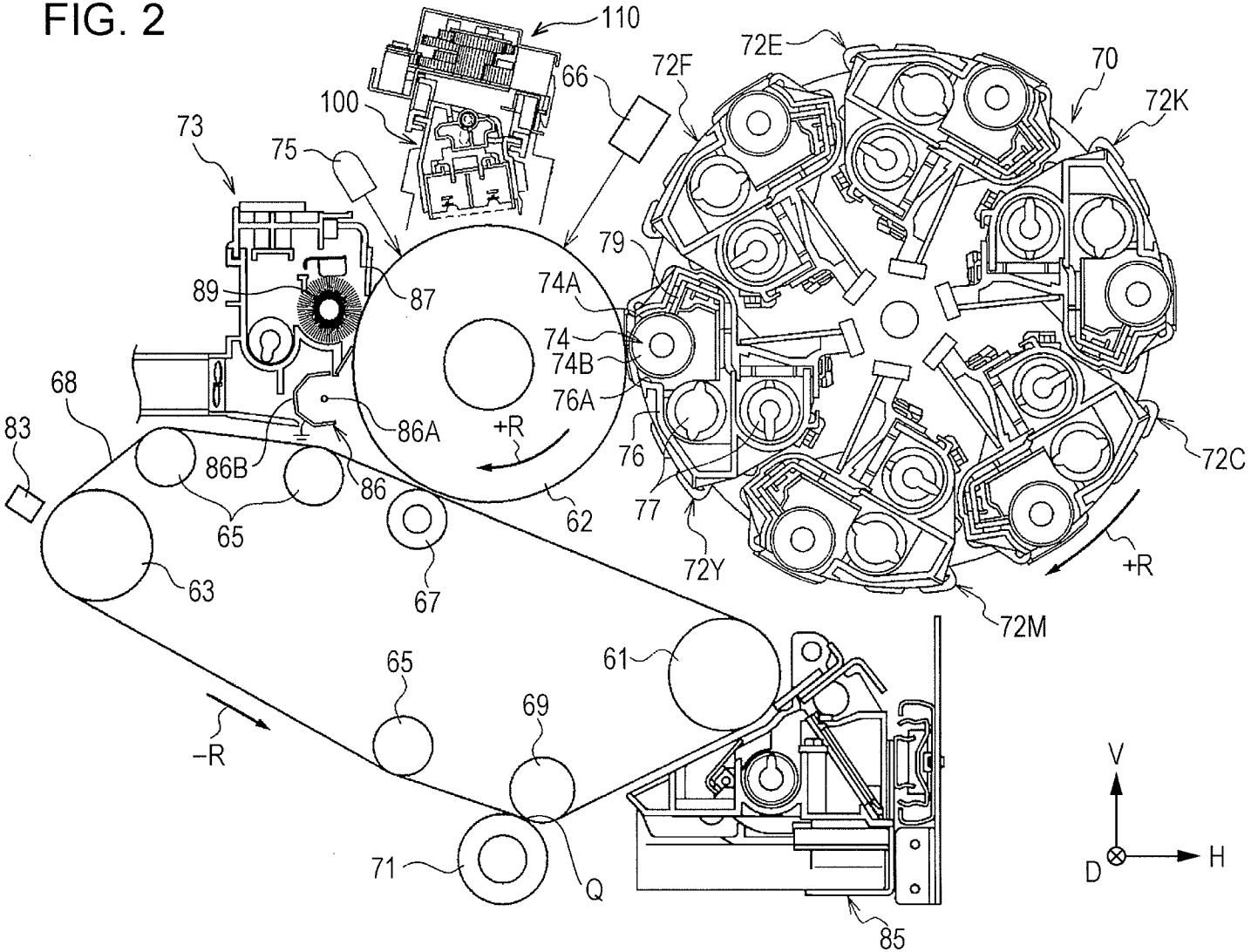
FIG. 2 illustrates the structure of an image forming unit according to the exemplary embodiment of the present invention.

As illustrated in FIG. 2, the charging unit 100 is attached to an attachment portion 110 disposed in the image forming unit 14 (see FIG. 1), and is retained such that the charging unit 100 faces the outer peripheral surface of the photoconductor 62. An exposure device 66 is provided so as to face the outer peripheral surface of the photoconductor 62 at a position downstream of the charging unit 100 in the rotational direction of the photoconductor 62. The exposure device 66 includes a light emitting diode (LED). The outer peripheral surface of the photoconductor 62 that has been charged by the charging unit 100 is irradiated with light (exposed to light) by the exposure device 66 on the basis of an image signal corresponding to each color of toner. Thus, an electrostatic latent image is formed. The exposure device 66 is not limited to those including LEDs. For example, the exposure device 66 may be structured such that the outer peripheral surface of the photoconductor 62 is scanned with a laser beam by using a polygon mirror.

A rotation-switching developing device 70, which is an example of a developing unit (for forming a toner image), is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color.

The developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An intermediate transfer belt 68, which is an example of a recording medium, is provided downstream of the developing device 70 in the rotational direction of the photoconductor 62 and below the photoconductor 62. A toner image formed on the outer peripheral surface of the photoconductor 62 is transferred onto the intermediate transfer belt 68.

The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow –R (counterclockwise in FIG. 2) when the driving roller 61 is rotated.

A first transfer roller 67, which is an example of a transfer unit, is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71, which is also an example of a transfer unit, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P (see FIG. 1). The position between the second transfer roller 71 and the auxiliary roller 69 serves as the second transfer position (position Q in FIG. 2) at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 85 is opposed to the driving roller 61 with the intermediate transfer belt 68 interposed therebetween. The cleaning device 85 collects residual toner that remains on the intermediate transfer belt 68 after the second transfer process. A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade 87 and a brush roller 89 that are in contact with the surface of the photoconductor 62. A post-transfer corotron 86 is provided upstream of the cleaning device 73 and downstream of the first transfer roller 67 in the rotational direction of the photoconductor 62.

The post-transfer corotron 86 includes a charge wire 86A to which a voltage is applied by a voltage applying unit (not shown) and a shielding member 86B which covers the charge wire 86A and which is grounded. The post-transfer corotron 86 has a function of changing the reverse polarity (positive polarity in the present exemplary embodiment) of the electric charge that remains on the outer peripheral surface of the photoconductor 62 to the polarity with which the photoconductor 62 is charged by the charging unit 100, that is, to the negative polarity, after the first transfer process is performed by the first transfer roller 67. An erase lamp 75 for removing the electric charge after the collection of the residual toner and the like may be provided downstream of the cleaning device 73 and upstream of the charging unit 100.

As illustrated in FIG. 1, the second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71.

The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the direction shown by arrow H in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected.

When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

An image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

Next, as illustrated in FIG. 2, the outer peripheral surface of the photoconductor 62 is charged by the charging unit 100. Then, the exposure device 66 emits light in accordance with the image data, and the outer peripheral surface of the photoconductor 62, which has been charged by the charging unit 100, is exposed to the emitted light. Accordingly, an electrostatic latent image corresponding to the yellow image data is formed on the surface of the photoconductor 62. The electrostatic latent image formed on the surface of the photoconductor 62 is developed as a yellow toner image by the developing unit 72Y. The yellow toner image on the surface of the photoconductor 62 is transferred onto the intermediate transfer belt 68 by the first transfer roller 67.

Then, the developing device 70 is rotated by 60° in the direction shown by arrow +R, so that the developing unit 72M is opposed to the surface of the photoconductor 62. Then, the charging process, the exposure process, and the developing process are performed so that a magenta toner image is formed on the surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

A sheet of recording paper P is fed from the sheet storing unit 12 and transported along the transport path 28, as illustrated in FIG. 1. Then, the sheet is transported by the positioning rollers 38 to the second transfer position (position Q in FIG. 2) in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction shown by arrow A (rightward in FIG. 1). The fixing device 80 fixes the toner images to the sheet of recording paper P by applying heat and pressure thereto with the heating roller 82 and the pressing roller 84. The sheet of recording paper P to which the toner images are fixed is ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction shown by arrow −V. Then, the sheet of recording paper P is transported in the direction shown by arrow +V, so that the leading and trailing edges of the sheet of recording paper P are reversed. Then, the sheet of recording paper P is transported along the duplex-printing transport path 29 in the direction shown by arrow B (leftward in FIG. 1), and is inserted into the transport path 28. Then, the back surface of the sheet of recording paper P is subjected to the image forming process and the fixing process.

Next, the charging unit 100 will be described.

Figure 3:
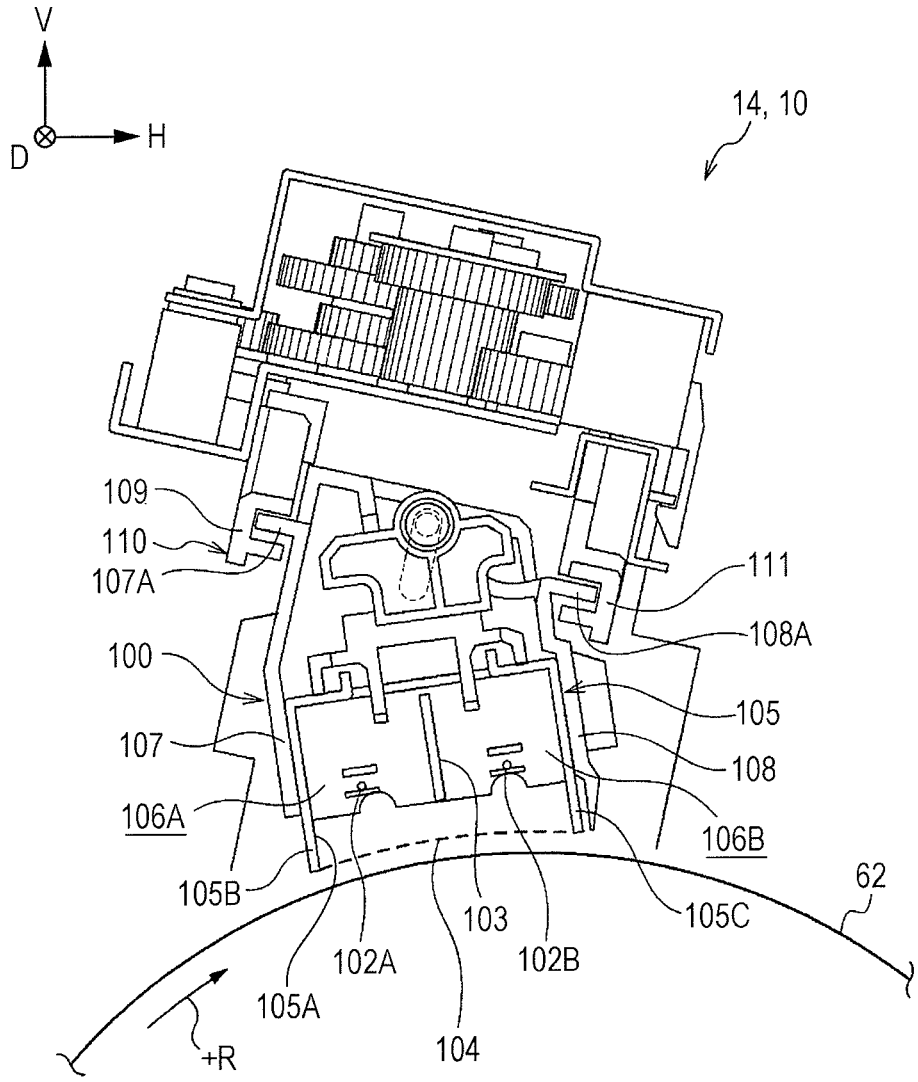
FIG. 3 illustrates the structure of an area around a photoconductor according to the exemplary embodiment of the present invention.

As illustrated in FIG. 3, the charging unit 100 includes a shielding member 105 that is angular U-shaped in the H-V plane (cross section). The inner space of the shielding member 105 is divided into chambers 106A and 106B with a partition plate 103 that stands so as to extend in the direction shown by arrow D. The chamber 106A is at the upstream side in the direction shown by arrow +R, and the chamber 106B is at the downstream side in the direction shown by arrow +R. The shielding member 105 has an opening 105A that faces the outer peripheral surface of the photoconductor 62.

A charge wire 102A, which is an example of a charging member, is disposed in the chamber 106A so as to extend in the direction shown by arrow D. Similarly, a charge wire 102B, which is also an example of a charging member, is disposed in the chamber 106B so as to extend in the direction shown by arrow D. A grid electrode 104, which is an example of an electrode member, is attached to the shielding member 105 so as to cover the opening 105A. The grid electrode 104 is disposed between the charge wires 102A and 102B and the outer peripheral surface of the photoconductor 62 in the H-V plane.

Cover members 107 and 108 that stand in the direction shown by arrow V are attached to outer surfaces of a pair of side walls 105B and 105C of the shielding member 105 that face each other in the direction shown by arrow H. The cover member 107 is bent outward (leftward in FIG. 3) into the shape of the letter 'L' at the top end thereof, and thus a plate-shaped guide member 107A is formed. The cover member 108 is bent outward (rightward in FIG. 3) into the shape of the letter 'L' at the top end thereof, and thus a plate-shaped guide member 108A is formed. The guide members 107A and 108A are guided in the direction shown by arrow D and retained (restrained from being moved) in the directions shown by arrows H and V by guide rails 109 and 111, which are provided on the attachment portion 110. Accordingly, the charging unit 100 is disposed so as to face the outer peripheral surface of the photoconductor 62.

Figure 4A:
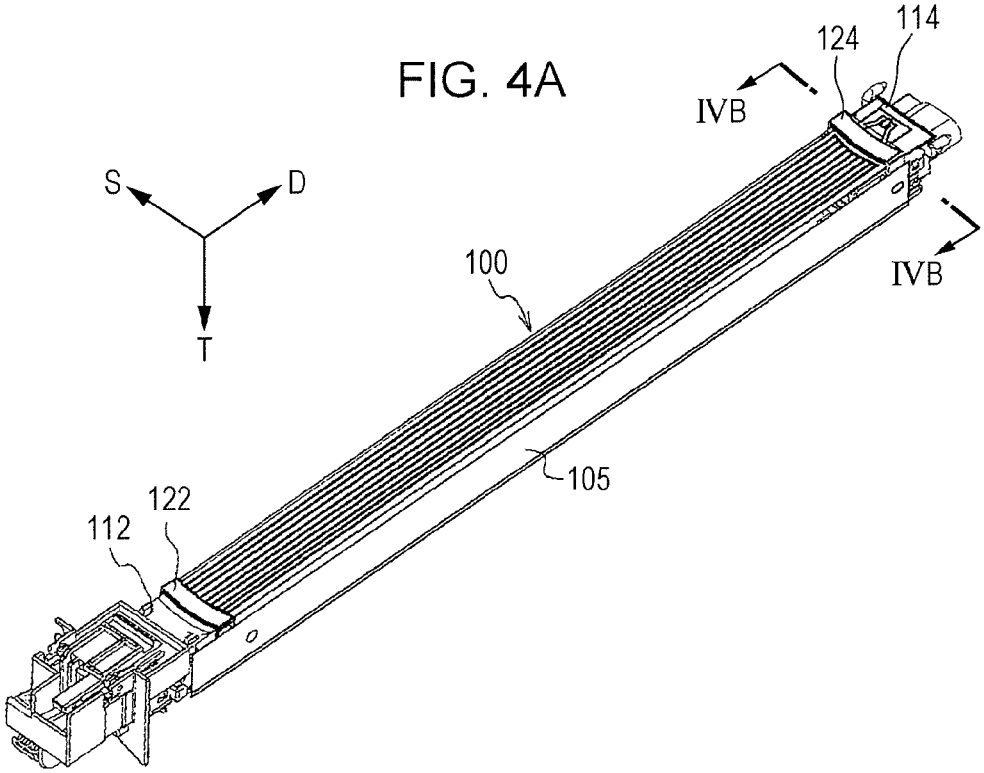
FIG. 4A is a perspective view of a charging unit according to the exemplary embodiment of the present invention.

As illustrated in FIG. 4A, attachment members 112 and 114 are attached to the shielding member 105 of the charging unit 100 at the ends thereof in the direction shown by arrows D. The attachment members 112 and 114 are used to attach (retain) the grid electrode 104. The attachment member 112 is provided at the front end in the direction shown by arrow D, and the attachment member 114 is provided at the back end in the direction shown by arrow D. The cover members 107 and 108 are not illustrated in FIG. 4A. In the following description and the drawings, the long-side direction, the short-side direction, and the width direction of the grid electrode 104 correspond to the direction shown by arrow D, the direction shown by arrow S, and the direction shown by arrow T, respectively. The directions shown by arrows D, S, and T are orthogonal to each other.

Figure 6A:
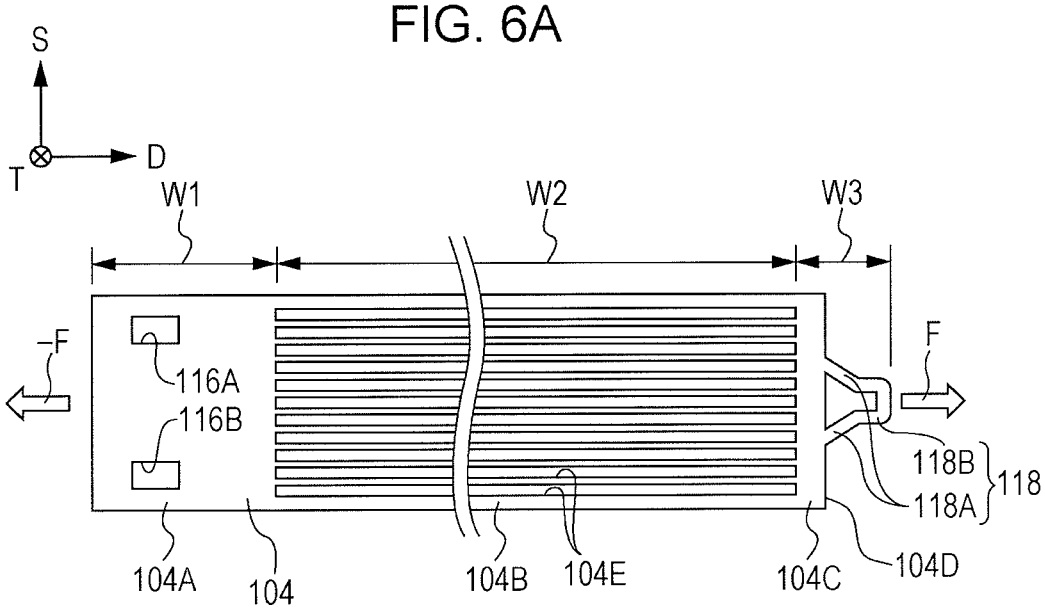
FIGS. 6A and 6B are a plan view and a side view, respectively, of a grid electrode according to the exemplary embodiment of the present invention.

As illustrated in FIG. 6A, the grid electrode 104 has the shape of a plate (a rectangular shape in plan view and a plate shape in side view) that has a longitudinal direction in the axial direction of the photoconductor 62 (see FIG. 3) (direction shown by arrow D) when no load is applied. The grid electrode 104 is elastically deformed and curved when a load is applied thereto. The grid electrode 104 includes, in order from the front end to the back end in the direction shown by arrow D, an attachment portion 104A having a width W1, an electrode portion 104B having a width W2, and an attachment portion 104C having a width W3, which are integrated with each other.

The grid electrode 104 is disposed between the charge wires 102A and 102B (see FIG. 3) and the photoconductor 62 (see FIG. 3) when viewed in the direction shown by arrow D. The grid electrode 104 is retained in a tensioned state at both ends thereof in the direction shown by arrow D so as to extend in the direction shown by arrow D. A voltage is applied to the grid electrode 104 by a feeder unit (not shown). Here, members having the shape of a plate are not limited to flat plate-shaped members, and include members that are slightly curved when viewed in the direction shown by arrow D.

The attachment portion 104A has attachment holes 116A and 116B, which are through holes that extend through the attachment portion 104A in the direction shown by arrow T. The attachment holes 116A and 116B have a rectangular shape and are formed with an interval therebetween in the direction shown by arrow S at a first end of the grid electrode 104. Plural slits 104E are formed in the electrode portion 104B. The slits 104E have a rectangular shape that extends in the direction shown by arrow D, and are arranged in the direction shown by arrow S.

Figure 6B:
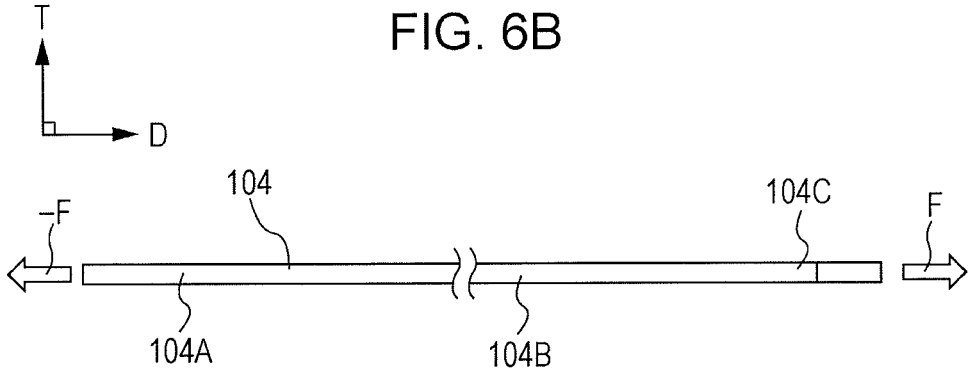

An attachment piece 118 that projects in the direction shown by arrow D is formed on the attachment portion 104C. The attachment piece 118 includes two support portions 118A that are slanted toward each other in plan view and a hook portion 118B that is angular-U-shaped in plan view and that is integrated with each of the two support portions 118A at an end thereof. The other end of each support portion 118A is integrated with a surface 104D at a second end of the grid electrode 104 (surface at the back end in the direction shown by arrow D) at a central area thereof in the direction shown by arrow S. As illustrated in FIG. 6B, the top surfaces of the attachment portion 104A, the electrode portion 104B, and the attachment portion 104C are flush with each other.

Figure 5A:
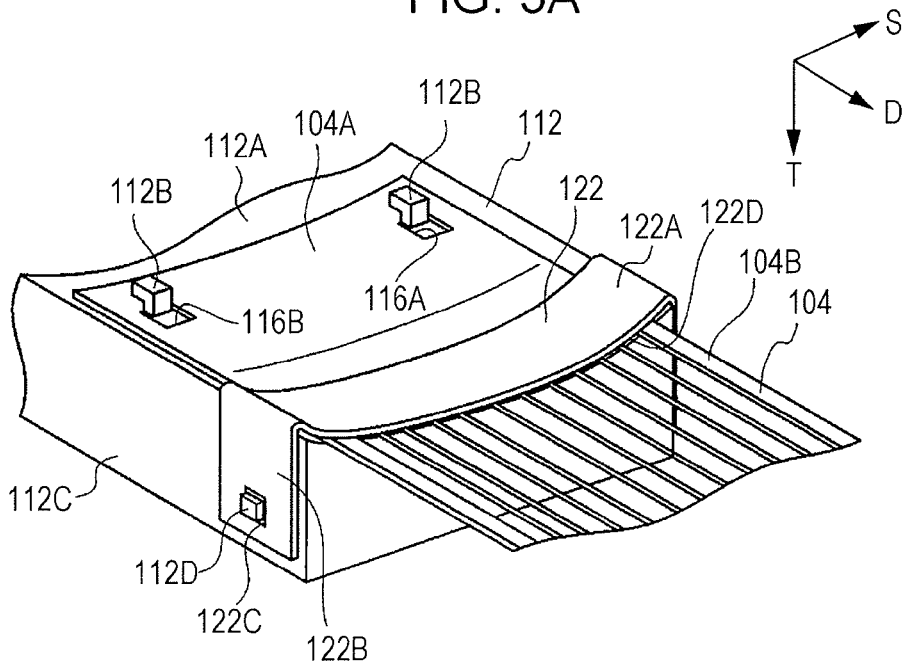
FIGS. 5A and 5B illustrate an attachment structure of the charging unit according to the exemplary embodiment of the present invention.

Referring to FIG. 5A, the attachment member 112 is an example of a curved member, and includes a curved surface 112A and side surfaces 112C. The curved surface 112A is disposed between the grid electrode 104 and the charge wires 102A and 102B (see FIG. 3) and extends along the outer peripheral surface of the photoconductor 62 (see FIG. 3). The side surfaces 112C extend downward from the curved surface 112A at the ends thereof in the direction shown by arrow S.

Two L-shaped hook portions 112B that project upward and that are bent in a direction opposite to the direction shown by arrow D are formed on the curved surface 112A. The size of the two hook portions 112B is set such that the hook portions 112B may be inserted into the attachment holes 116A and 116B. Projections 112D used to fix a leaf spring 122, which will be described below, project from the side surfaces 112C of the attachment member 112 (only one of the side surfaces 112C is illustrated). The hook portions 112B are engaged with the edges of the attachment holes 116A and 116B in the grid electrode 104, so that the first end of the grid electrode 104 is positioned. The grid electrode 104 is retained at the first end thereof by the pushing force applied by the leaf spring 122, which is an example of an pushing member, such that the grid electrode 104 is curved along the outer peripheral surface of the photoconductor 62.

The leaf spring 122 includes a curved portion 122A and attachment portions 122B which are integrated with each other. The curved portion 122A extends in the direction shown by arrow S and is curved to be convex in the direction shown by arrow T (downward in FIG. 5A). The attachment portions 122B extend in the direction shown by arrow T from the ends of the curved portion 122A in the direction shown by arrow S. Engagement holes 122C, which are through holes that engage with the projections 112D, are formed in the attachment portions 122B. The convex surface of the curved portion 122A serves as a contact surface 122D that contacts the grid electrode 104.

The leaf spring 122 is disposed between the grid electrode 104 and the photoconductor 62 (see FIG. 3). The projections 112D are engaged with the edges of the engagement holes 122C, so that the grid electrode 104 is pressed by the curved portion 122A and is urged in a direction toward the curved surface 112A of the attachment member 112. As described above, the grid electrode 104 is retained by the pushing force of the leaf spring 122 such that the grid electrode 104 is curved along the outer peripheral surface of the photoconductor 62.

Figure 5B:
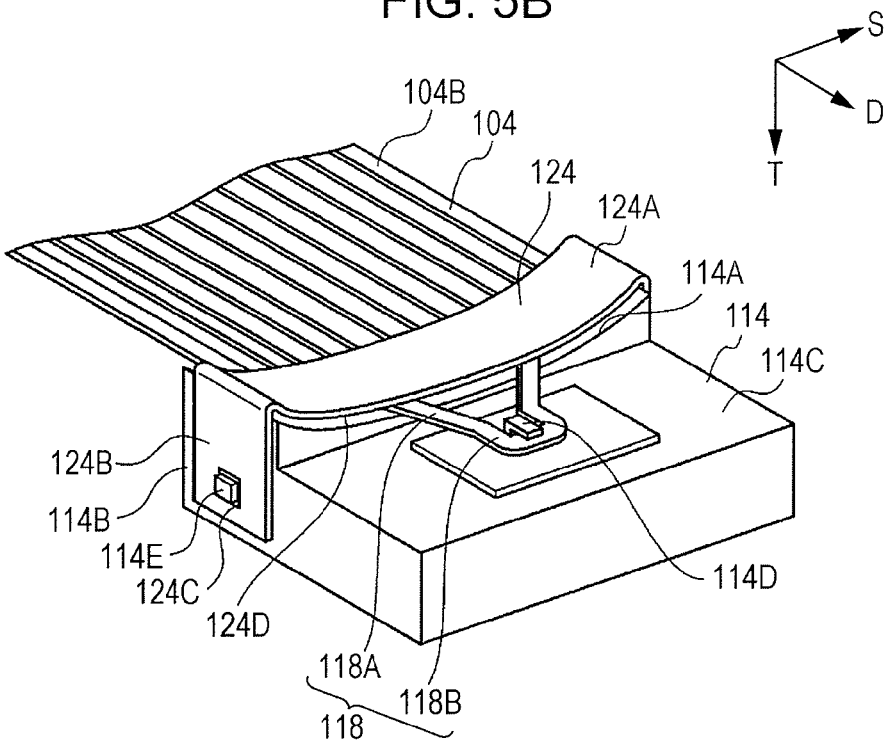

Referring to FIG. 5B, the attachment member 114 is an example of a curved member, and includes a curved surface 114A, side surfaces 114B, and an attachment surface 114C. The curved surface 114A is disposed between the grid electrode 104 and the charge wires 102A and 102B (see FIG. 3) and extends along the outer peripheral surface of the photoconductor 62 (see FIG. 3). The side surfaces 114B extend downward from the curved surface 114A at the ends thereof in the direction shown by arrow S. The attachment surface 114C is provided at the second end in the direction shown by arrow D such that the attachment surface 114C is lower than the curved surface 114A.

An L-shaped hook portion 114D that projects upward and that is bent in the direction shown by arrow D is formed on the attachment surface 114C. The hook portion 114D is formed on the attachment surface 114C at a central area thereof in the direction shown by arrow S. The size of the hook portion 114D is set such that the hook portion 118B of the grid electrode 104 may be engaged with the hook portion 114D. Projections 114E used to fix a leaf spring 124, which will be described below, project from the side surfaces 114B of the attachment member 114 (only one of the side surfaces 114B is illustrated). The hook portion 118B of the grid electrode 104 is engaged with the hook portion 114D, so that the second end of the grid electrode 104 is positioned. The grid electrode 104 is retained at the second end thereof by the pushing force applied by the leaf spring 124, which is an example of a pushing member, such that the grid electrode 104 is curved along the outer peripheral surface of the photoconductor 62.

The leaf spring 124 includes a curved portion 124A and attachment portions 124B which are integrated with each other. The curved portion 124A extends in the direction shown by arrow S and is curved to be convex in the direction shown by arrow T (downward in FIG. 5A). The attachment portions 124B extend in the direction shown by arrow T from the ends of the curved portion 124A in the direction shown by arrow S. Engagement holes 124C, which are through holes that engage with the projections 114E, are formed in the attachment portions 124B. The convex surface of the curved portion 124A serves as a contact surface 124D that contacts the grid electrode 104.

The leaf spring 124 is disposed between the grid electrode 104 and the photoconductor 62 (see FIG. 3). The projections 114E are engaged with the edges of the engagement holes 124C, so that the grid electrode 104 is pressed by the curved portion 124A and is urged in a direction toward the curved surface 114A of the attachment member 114. As described above, the grid electrode 104 is retained by the pushing force of the leaf spring 124 such that the grid electrode 104 is curved along the outer peripheral surface of the photoconductor 62. Projecting contact portions (not shown) formed on the attachment members 112 and 114 are in contact with top portions of holders (not shown) provided at the ends of the photoconductor 62 (see FIG. 2), so that a distance d between the photoconductor 62 and the grid electrode 104 is maintained at a certain distance.

Figure 4B:
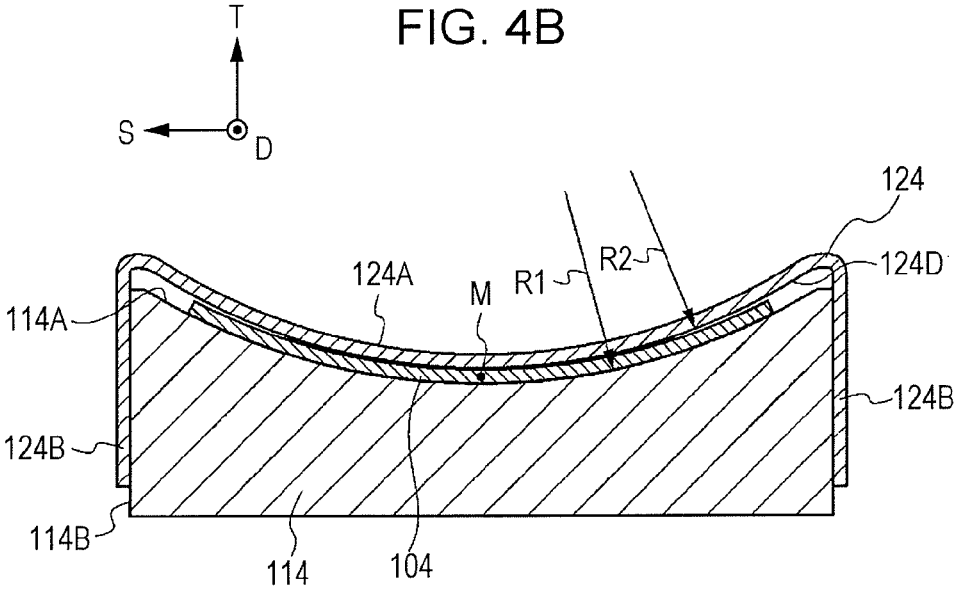
FIG. 4B is a sectional view of the charging unit according to the exemplary embodiment of the present invention taken along line IVB-IVB in FIG. 4A.

Referring to FIG. 4B, which is a sectional view of the attachment member 114 and the leaf spring 124 taken along the S-T plane, the curved surface 114A of the attachment member 114 extends along the outer peripheral surface of the photoconductor 62 (see FIG. 2) and has a radius of curvature R1. The contact surface 124D of the leaf spring 124 has a radius of curvature R2 that is smaller than the radius of curvature R1 of the curved surface 114A. Accordingly, the pushing force applied to the grid electrode 104 by the leaf spring 124 is largest at the center M of the grid electrode 104 in the direction shown by arrow S. The curved surface 112A and the leaf spring 122 have structures similar to those of the curved surface 114A and the leaf spring 124, and explanations of the radii of curvature of the curved surface 112A and the leaf spring 122 will thus be omitted.

Next, the operation of the present exemplary embodiment will be described.

Referring to FIG. 5A, in the process of attaching the grid electrode 104, first, the edges of the attachment holes 116A and 116B are engaged with the two hook portions 112B of the attachment member 112. At this time, the attachment piece 118 at the second end and the leaf springs 122 and 124 are not yet attached. Then, as illustrated in FIGS. 6A and 6B, the attachment piece 118 is pulled in the direction shown by arrow D. In this state, the grid electrode 104 extends horizontally and is not curved, as illustrated in FIG. 7A.

Next, as illustrated in FIG. 5B, the attachment piece 118 at the second end of the grid electrode 104 is engaged with the hook portion 114D of the attachment member 114. Accordingly, as illustrated in FIG. 6A, tensile forces F and −F are applied to the end portions of the grid electrode 104 in the direction shown by arrow D at the central areas thereof in the direction shown by arrow S. Although the grid electrode 104 becomes curved when the curved surface 114A and the curved surface 112A (see FIG. 5A) come into contact therewith, the grid electrode 104 is not yet curved along the outer peripheral surface of the photoconductor 62 (see FIG. 3) at this time.

Figure 7A:
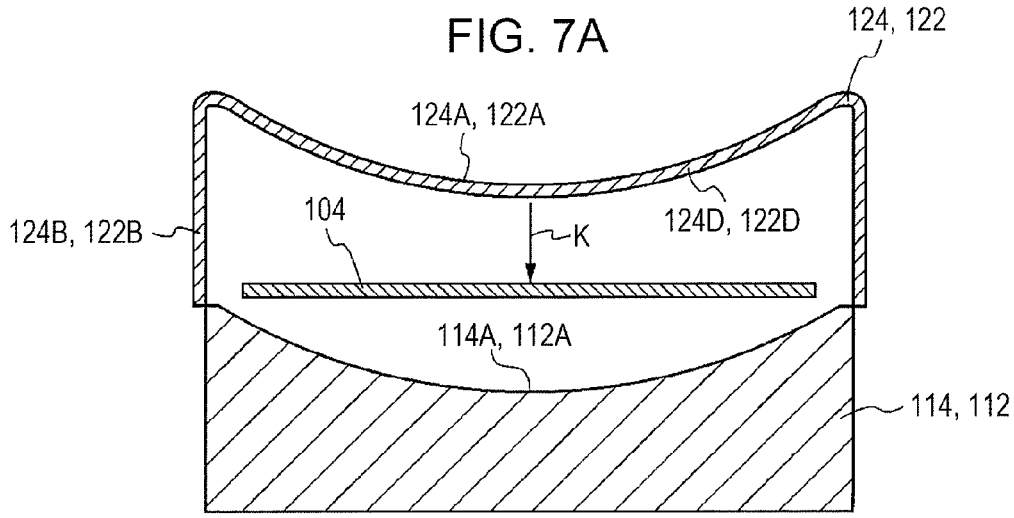
FIGS. 7A, 7B, and 7C are sectional views illustrating steps of assembling the charging unit according to the exemplary embodiment of the present invention.

Next, as illustrated in FIGS. 5A, 5B, and 7A, the edges of the engagement holes 122C in the leaf spring 122 are engaged with the projections 112D and the edges of the engagement holes 124C in the leaf spring 124 are engaged with the projections 114E, so that the leaf springs 122 and 124 are attached to the attachment members 112 and 114, respectively. Thus, the grid electrode 104 is attached to the attachment members 112 and 114.

Figure 7B:
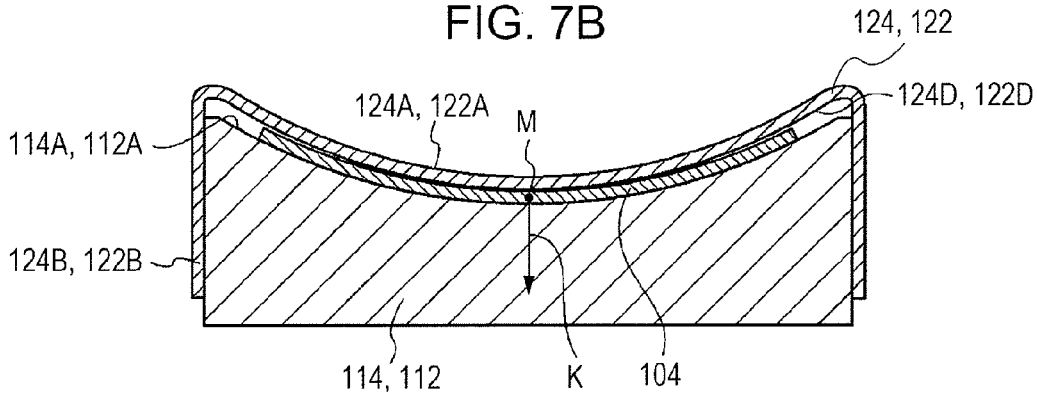

In this step, as illustrated in FIGS. 4B and 7B, the grid electrode 104 that is retained in a tensioned state at both ends thereof is urged in the direction shown by arrow K (direction toward the attachment members 112 and 114) when the contact surfaces 122D and 124D of the leaf springs 122 and 124 come into contact with the grid electrode 104. Accordingly, the grid electrode 104 is curved along the curved surfaces 112A and 114A of the attachment members 112 and 114. In other words, the grid electrode 104 is curved along the outer peripheral surface of the photoconductor 62 (see FIG. 2). The grid electrode 104 in the curved state is retained between the attachment member 112 and the leaf spring 122 and between the attachment member 114 and the leaf spring 124.

Figure 7C:
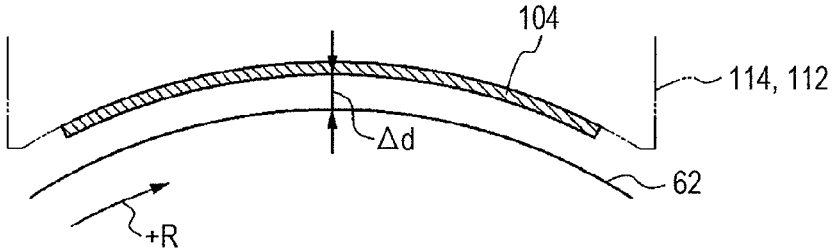

Accordingly, as illustrated in FIG. 7C, a distance Δd between the outer peripheral surface of the photoconductor 62 and the grid electrode 104 is set within an allowable range along the circumferential direction of the photoconductor 62. Thus, variation in the distance Δd between the outer peripheral surface of the photoconductor 62 and the grid electrode 104 along the circumferential direction of the photoconductor 62 may be reduced. If the grid electrode 104 approaches the outer peripheral surface of the photoconductor 62, there is a possibility that the grid electrode 104 will vibrate. However, in the present exemplary embodiment, the grid electrode 104 is restrained from moving toward the photoconductor 62 by the leaf springs 122 and 124. In other words, the leaf springs 122 and 124 function as restraining members. Accordingly, the grid electrode 104 is prevented from approaching the outer peripheral surface of the photoconductor 62, and unevenness in charging of the photoconductor 62 may be reduced. As a result, unevenness in image density may be reduced.

Since the radius of curvature R2 of the contact surface 124D is smaller than the radius of curvature R1 of the curved surface 114A as illustrated in FIG. 4B, the pushing force applied to the grid electrode 104 is largest at the center M thereof in the direction shown by arrow S. Therefore, compared to the case in which the radius of curvature R2 of the contact surface 124D is larger than the radius of curvature R1 of the curved surface 114A, a larger pushing force is applied to a portion of the grid electrode 104 around the center M, which is to be curved by a largest amount. Accordingly, the grid electrode 104 is shaped along the curved surface 114A. The curved surface 112A and the leaf spring 122 have structures similar to those of the curved surface 114A and the leaf spring 124, and explanations thereof will thus be omitted.

Since the slits 104E are formed in the electrode portion 104B of the grid electrode 104 as illustrated in FIG. 6A, the electrode portion 104B becomes curved similarly to the manner in which the attachment portions 104A and 104C are curved. Therefore, even though the electrode portion 104B is not urged by the leaf springs 122 and 124, the electrode portion 104B is also curved. As illustrated in FIG. 5B, when the grid electrode 104 is attached to the attachment member 114, the bottom surface of the electrode portion 104B and the bottom surface of the attachment piece 118 are at the same height at the central area of the grid electrode 104 in the direction shown by arrow S. Therefore, the grid electrode 104 receives a tensile force in a horizontal direction and no component of force is applied in the downward direction in this area.

Referring to FIG. 3, in the charging unit 100, electricity is supplied to the charge wires 102A and 102B, so that a potential difference is generated between the charge wires 102A and 102B and the photoconductor 62 that is grounded. Accordingly, corona discharge occurs and the photoconductor 62 is charged. A bias voltage is applied to the grid electrode 104, so that the charge potential (discharge current) of the photoconductor 62 is within an allowable range.

The present invention is not limited to the above-described exemplary embodiment.

The grid electrode 104 is not limited to those having slits, and may have a mesh pattern including plural polygonal holes. Components for pushing the grid electrode 104 in a direction toward the curved surfaces 112A and 114A are not limited to leaf springs, and the grid electrode 104 may instead be urged by coil springs supported by support members or cams.

The state in which the grid electrode 104 is arranged along the outer peripheral surface of the photoconductor 62 is not limited to the state in which the distance between the grid electrode 104 and the outer peripheral surface of the photoconductor 62 is constant, and includes the state in which the center of the grid electrode 104, which is curved, is shifted upstream or downstream in the rotational direction of the photoconductor 62. For example, the distance between the grid electrode 104 and the photoconductor 62 may be larger at the downstream side than at the upstream side in the rotational direction of the photoconductor 62.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that charges an outer peripheral surface of a cylindrical image carrier;

an electrode member that has the shape of a plate having a longitudinal direction in an axial direction of the image carrier and that is disposed above the charging member;

an attachment member that has a curved surface which is curved along the outer peripheral surface of the image carrier, the electrode member being attached thereon; and a pushing member disposed between the electrode member and the image carrier, the pushing member pushing the electrode member toward the curved surface so that the electrode member is curved to follow the curved surface, wherein the pushing member is configured to apply more pressure to a center of the electrode member in a non-axial direction than at edges of the electrode member in the non-axial direction.

2. The charging device according to claim 1, wherein the electrode member is retained in a tensioned state at both end portions of the electrode member in the longitudinal direction so as to extend in the axial direction of the image carrier.

3. The charging device according to claim 2, wherein the electrode member is attached to the attachment member at a first end portion and a second end portion, the curved surface having a first engagement portion thereon at the first end portion so that the electrode member is engaged at the first end portion.

4. The charging device according to claim 3, wherein the attachment member has an attachment surface at the second end, the attachment surface being distant from the image carrier than the curved surface and having a second engagement portion thereon so that the electrode member is engaged at the second end portion.

5. An image forming apparatus comprising:

the charging device according to claim 2;

an image carrier that is charged by the charging device and carries a latent image formed by exposing light thereto;

a developing unit that develops the latent image with developer to form a toner image; and a transfer unit that transfers the toner image onto a recording medium.

6. The charging device according to claim 1, wherein a plurality of slits are formed in the electrode member.

7. An image forming apparatus comprising:

the charging device according to claim 1;

an image carrier that is charged by the charging device and carries a latent image formed by exposing light thereto;

a developing unit that develops the latent image with developer to form a toner image; and a transfer unit that transfers the toner image onto a recording medium.

8. A charging device comprising:

a charging member that charges an outer peripheral surface of a cylindrical image carrier;

an electrode member that has the shape of a plate having a longitudinal direction in an axial direction of the image carrier and that is disposed above the charging member;

an attachment member that has a curved surface which is curved along the outer peripheral surface of the image carrier, the electrode member being attached thereon; and a pushing member disposed between the electrode member and the image carrier, the pushing member pushing the electrode member toward the curved surface so that the electrode member is curved to follow the curved surface, wherein the pushing member is a leaf spring having a contact surface that has a smaller radius of curvature than a radius of curvature of the curved surface and that is in contact with the electrode member.

9. An image forming apparatus comprising:

the charging device according to claim 8;

an image carrier that is charged by the charging device and carries a latent image formed by exposing light thereto;

a developing unit that develops the latent image with developer to form a toner image; and a transfer unit that transfers the toner image onto a recording medium.

* * * * *